United States Patent [19]

Evenson

[11] 3,987,656

[45] Oct. 26, 1976

[54] PIPE BENDING APPARATUS

[75] Inventor: Raymond M. Evenson, New Berlin, Wis.

[73] Assignee: Applied Power Inc., Milwaukee, Wis.

[22] Filed: Oct. 14, 1975

[21] Appl. No.: 621,652

[52] U.S. Cl. ..... 72/154; 72/217

[51] Int. Cl.[2] ..... B21D 7/04

[58] Field of Search ..... 72/149, 150, 154, 155, 72/156, 157, 158, 159, 217, 218, 219

[56] References Cited

UNITED STATES PATENTS

| | | | |
|---|---|---|---|
| 983,664 | 2/1911 | Wilson | 72/157 |
| 1,935,604 | 11/1933 | Abramson et al. | 72/154 |
| 2,375,310 | 5/1945 | Mandl | 72/154 |
| 3,059,683 | 10/1962 | Atherton | 72/159 |
| 3,555,868 | 1/1971 | Hagemeyer | 72/154 |

FOREIGN PATENTS OR APPLICATIONS

| | | | |
|---|---|---|---|
| 153,478 | 10/1953 | Australia | 72/154 |
| 541,972 | 10/1955 | Belgium | 72/154 |
| 3,349 | 2/1897 | United Kingdom | 72/217 |

*Primary Examiner*—Milton S. Mehr
*Assistant Examiner*—E. M. Combs
*Attorney, Agent, or Firm*—James E. Nilles

[57] ABSTRACT

A pipe bending apparatus for bending large diameter pipe of either thin or thick walled construction. The pipe bending apparatus includes a bending shoe which is pivotably mounted to a frame member and a follower shoe which is operable with the bending shoe to receive a pipe therebetween for bending. The apparatus also includes a fluid motor which is operable to cause pivotal movement of the bending shoe and a clamping assembly comprising a plurality of rollers which are secured together to clampingly engage the follower shoe and the bending shoe to force them together such that the pipe is forced to conform to the arcuate configuration of the bending shoe as the bending shoe pivots. During such pivotal movement, the rollers of the clamping assembly traverse the arcuate surface of the bending shoe and the rear surface of the follower shoe clamping the pipe between the bending and follower shoe and causing the pipe to assume the configuration of the bending shoe in a rolling mill type operation.

9 Claims, 9 Drawing Figures

PIPE BENDING APPARATUS

BACKGROUND OF THE INVENTION

The present invention pertains to a pipe bending apparatus for use in bending large diameter pipes which have either a thin or thick walled construction. More specifically, the invention is directed to a pivotable rolling mill type pipe bending mechanism wherein a pipe may be received between a bending shoe having an arcuate surface and a follower shoe and bent to assume the shape of the bending shoe by pivotal movement of the bending shoe.

SUMMARY OF THE INVENTION

The present invention provides an improved pipe bending apparatus which is capable of bending either a thin or thick walled pipe having a relatively large cross-sectional diameter. The apparatus is constructed to be generally portable and relatively compact yet to function in the manner of a rolling mill device wherein it is possible to maintain external pressure around the circumference of the pipe during the bending operation thereby preventing kinks or undue distortion even in very thin walled pipe during the bending process.

The invention comprises the combination of a bending shoe which is pivotably supported by a frame, a hydraulic motor which is operable to cause pivotal movement of the bending shoe and a means for forcing the pipe to assume the shape of the arcuate surface of the bending shoe upon actuation of the hydraulic motor. The frame comprises a pair of flat horizontally disposed elongated arms which rigidly support the fluid motor between them at one end and which pivotably support one end of the bending shoe at their other end. The bending shoe is generally semi-circular in configuration and has an arcuate outer surface which includes a groove for receiving a pipe therein.

The shoe is pivotably connected to the frame by a pivot pin located adjacent to the arcuate surface of the shoe and at one end thereof such that the pivot point of the shoe is off-set from the center of the arc defined by the surface of the shoe. The bending shoe is generally designed for use with an elongated straight follower shoe which includes a groove complementary to that in the arcuate surface of the bending shoe such that a pipe can be received therebetween in clamped engagement. The clamping means generally comprise a plurality of rollers which clampingly engage the follower shoe and the bending shoe and force them against the pipe received therebetween to compress the pipe. One roller is disposed within an arcuate slot in the bending shoe and another roller is disposed to abut the rear surface of the follower shoe. The rollers are secured against movement with respect to each other by a pair of linking plates which support the shafts of the rollers.

In operation, when the fluid motor is actuated, the roller assembly connected to the end of the fluid motor piston places a torque on the bending shoe causing the bending shoe to pivot. As the bending shoe pivots, the rollers of the securing means, which are spaced on opposite sides of the respective shoes, cause the shoes to place a compressive force on the pipe disposed therebetween. In a typical rolling mill action, the follower shoe will thus cause the pipe to be bent to conform to the arcuate shape of the bending shoe. Since pressure is maintained on the entire periphery of the pipe at the place where it is being bent, undue distortion or crimping of the pipe is avoided and a smooth bend is created.

The pipe bending apparatus of the invention thus functions to prevent undue distortion or kinks in even very thin walled pipe during the bending operation. Though the invention facilitates rolling mill type bending, the apparatus of the invention is relatively portable and compact. Furthermore, the roller disposed in the arcuate slot of the bending shoe is mounted on an eccentric cam which permits the distances between the rollers to be adjusted thereby providing means for adjusting the pressure applied to the pipes and facilitating use of the apparatus with pipes having varied wall thickness. Since the pressure applied to the pipe, using the apparatus of the invention, does not depend directly on the hydraulic pressure of the hydraulic motor, but rather on the compressive forces exerted by the opposed rollers, it is possible to use less powerful hydraulic motors than are permissible with prior art apparatus and thus conserve energy. The arrangement of the position of the pivot point of the bending shoe with respect to the hydraulic motor and the frame also permit even very large pipes to be bent in a complete 90° arc in a single bending cycle whereas prior art apparatus allow for only a 45° bend of larger pipes thus requiring two bending operations to achieve a 90° bend. The frame assembly of the present invention also facilitates the use of any of a variety of sizes of fluid motors and permits the use of fluid motors which have relatively short stroke pistons.

The arrangement of the rollers with respect to the follower shoe and the bending shoe have the advantage that they function to maintain consistent pressure upon the pipe throughout the bending cycle and do not vary with respect to the stage of operation. Furthermore, the present invention is a distinct advantage over the prior art bending apparatus wherein compression of the pipe was maintained by use of hydraulic pressure generated by the hydraulic motor in that, in the present invention, compression is maintained on the pipe solely by the clamping action of the rollers. The hydraulic motor functions to create torque on the bending shoe to cause it to pivot and to cause the pipe to be bent but does not control the compressive force on the pipe.

The invention has the additional advantage that it can be readily disassembled to permit, for example, substitution of alternative bending shoes etc., to facilitate bending of pipes having varied cross-sectional diameters.

As an alternative to the previously described operation of the invention, in the event that the pipe being bent has a sufficient inherent strength to be satisfactorily bent without compressive force being applied to its external surface, the follower shoe can be deleted and a pressure roller having a shape conforming to that of the pipe can be used instead.

Further advantages of the present invention will become readily apparent with reference to the drawings and the following description of the preferred embodiment. The invention illustrated in the drawings should not be viewed as a limitation of the present invention but merely depicts a single embodiment thereof. For example, though the invention is shown disposed in a generally horizontal plane, it should be readily apparent that the invention would function equally well in a vertical orientation.

DESCRIPTION OF THE PREFERRED EMBODIMENT

Figure 2:
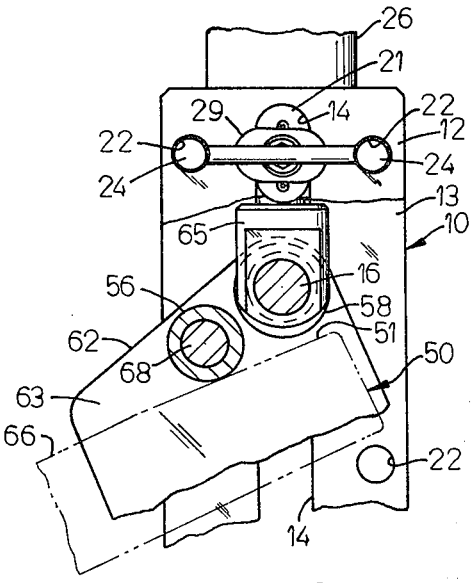
FIG. 2 is an enlarged partial view of the connection of the clamping assembly to the hydraulic motor.
Figure 1:
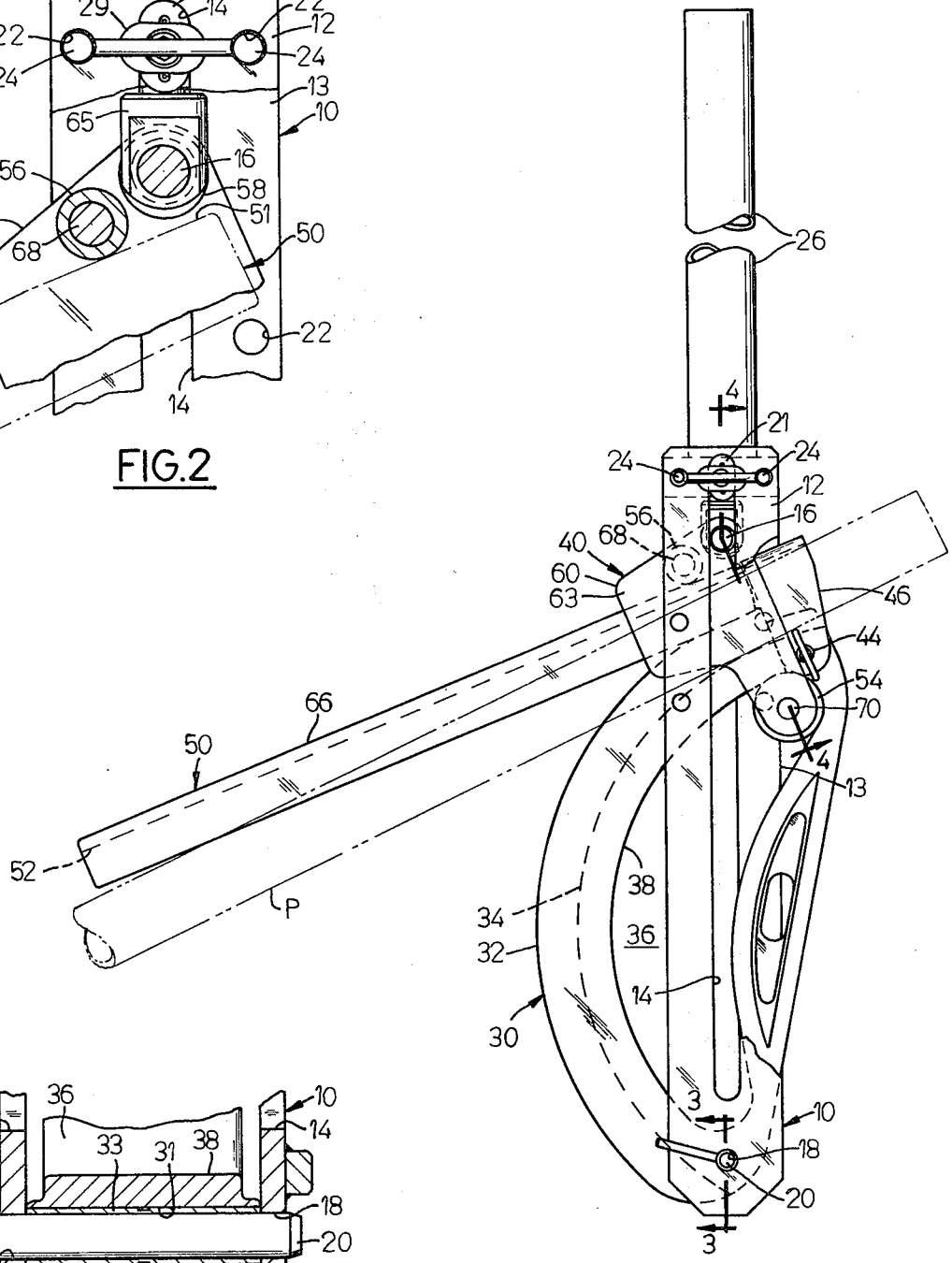
FIG. 1 is a plan view of the pipe bending apparatus of the present invention at the commencement of a pipe bending operation.

Generally the pipe bending apparatus of the present invention, shown in a plan view in FIG. 1, is comprised of a horizontally extending frame 10, a bending shoe 30 which is pivotably mounted to the frame 10 for horizontal pivoting movement and means for bending a pipe P to conform to the configuration of the arcuate surface 32 of the bending shoe 30. A hydraulic motor 26 is rigidly secured to the frame 10 and includes a piston 64 operably connected to a clamping assembly 40 which functions to force a follower shoe 50 into engagement with the bending shoe 30 to cause the pipe P to conform to the configuration of the bending shoe.

The frame 10 is comprised of a pair of parallel vertically separated frame arms 12 and 13 which are spaced to receive therebetween the bending shoe 30, the pipe P, the follower shoe 50 and the hydraulic motor 26. The frame arms 12 and 13 each include a central axially extending elongated slot 14 for receiving the ends of a vertically extending pin 16 for slideable movement therein. The frame arms 12 and 13 are provided with aligned bores 18 at one end for receiving a bending shoe pivot pin 20 which pivotably supports the bending shoe 30 with respect to the frame 10. The frame arms 12 and 13 include at their other end a pair of aligned bores 22 which receive fluid motor supporting pins 24.

Figure 3:
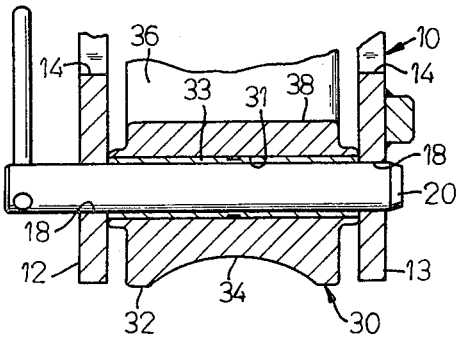
FIG. 3 is a cross-sectional view taken along the line 3—3 in FIG. 1.

FIG. 3 illustrates in greater detail the manner in which the bending shoe 30 is pivotably mounted with respect to the frame 10. The figure illustrates a cross-sectional view showing the removable pivot pin 20 extending through the aligned bores 18 in the upper and lower arms 12 and 13 and extending through a bore 31 in the bending shoe 30. A sleeve 33 is provided within the bore 31 for receiving the pivot pin 20 and for facilitating relatively free pivotal movement of the bending shoe with respect to the frame 10. The pivot pin 20 is freely slideable within the sleeve 33 and can be readily withdrawn to permit disassembly of the frame 10 in order to facilitate substitution of various bending shoes 30 depending upon the type and cross-sectional diameter of the pipe to be bent.

Figure 8:
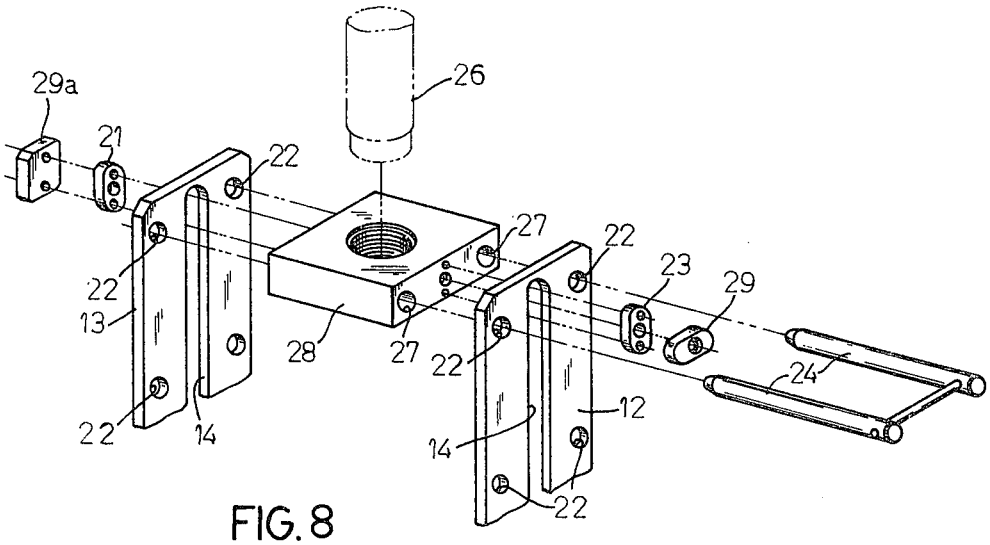
FIG. 8 is an exploded isometric view of portions of the frame assembly and the hydraulic motor.
Figure 9:
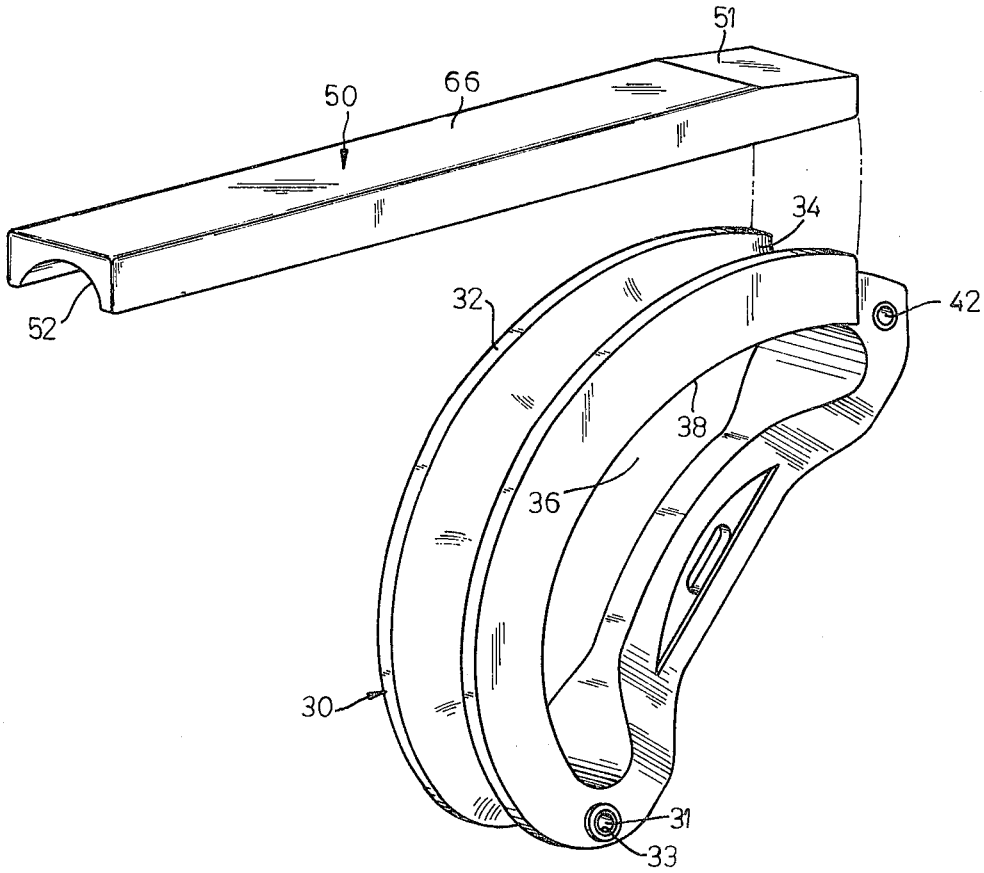
FIG. 9 is an exploded isometric view of the bending shoe and the follower shoe.

The supporting pins 24 which secure the fluid motor 26 between the frame arms 12 and 13 are also freely removable as best shown in FIG. 8. A fluid motor 26 is shown therein as including a cylinder head 28 received between the frame arms 12 and 13 and including a pair of bores 27 which are aligned with complementary bores 22 in the arms 12 and 13 to receive the supporting pins 24. The cylinder head 28 also includes keys 21 and 23 bolted to opposite surfaces. The keys 21 and 23 have a generally oval shape and are slideably receivable within the slots 14 in the arms 12 and 13. The keys 21 and 23 function to permit axial sliding movement of the hydraulic motor 26 in the slots 14 of the arms 12 and 13. A catch member 29 having a shape the same as that of the keys 21 and 23, is also screwed into the cylinder head 28 adjacent to the key 23 and is pivotable with respect to that key such that it can be positioned transverse to the axially extending slot 14, to hold the arm 12 in clamped engagement with respect to the cylinder head 28. However, the catch 29 can also be pivotably aligned with the key 23 such that, when the supporting pins 24 have also been removed, the arm 12 can be readily removed from the cylinder head 28. A catch pad **29*a* is also secured to the cylinder head 28 over the key 21 to slideably secure the arm 13 to the cylinder head 28. It should be noted that the frame arms 12 and 13 include additional spaced aligned bores 22 along their length such that the fluid motor 26 can be secured in alternative positions along the length of the frame 10** to permit the use of fluid motors having variable piston lengths and also to permit the bending of pipes having various diameters in a manner which will be described hereafter.

As previously stated, the bending shoe 30, which is secured to the frame 10 by the pivot pin 20 extending through the bores 18, is pivotable around the pivot pin 20 in a horizontal plane. The bending shoe has a configuration which includes an arcuate surface 32 having a groove 34 therein for receiving a pipe P. The groove 34 is generally semi-circular when taken in cross-section and the diameter of the groove is substantially the same as the outside diameter of the pipe to be bent. The bending shoe 30 also includes a central arcuate slot 36 which includes an arcuate surface 38 generally concentric with the arcuate surface 32. The arcuate surface 38 is generally flat and is designed to receive a roller 54 of the clamping assembly 40 during the pipe bending process as will be described. It should be noted that the bending shoe 30 is pivotable about a pivot point which is off-set from the center of an arc defined by the arcuate surfaces 32 and 38 since the pivot pin 20 is located adjacent to one end of the arc 32. Adjacent the opposite end of the arcuate surface 32 is a bore 42 designed to receive a pin 44 for securing a saddle 46 to the bending shoe 30. The saddle 46 generally comprises a U-shaped bracket which can be received around the e of a pipe to secure that end of the pipe to the bending shoe 30 during the bending process.

The follower shoe 50, which functions in conjunction with the bending shoe 30 to cause bending of the pipe P, is comprised of a generally elongated straight member with a groove 52 extending along its length. The groove 52 has a semi-circular cross-sectional configuration substantially equal to the groove 34 such that, when a pipe is received between the follower shoe 50 and the bending shoe 30, the pipe is surrounded by the grooves 34 and 52 and the respective shoes will cause a compressive force around the circumference of the pipe P.

Figure 4:
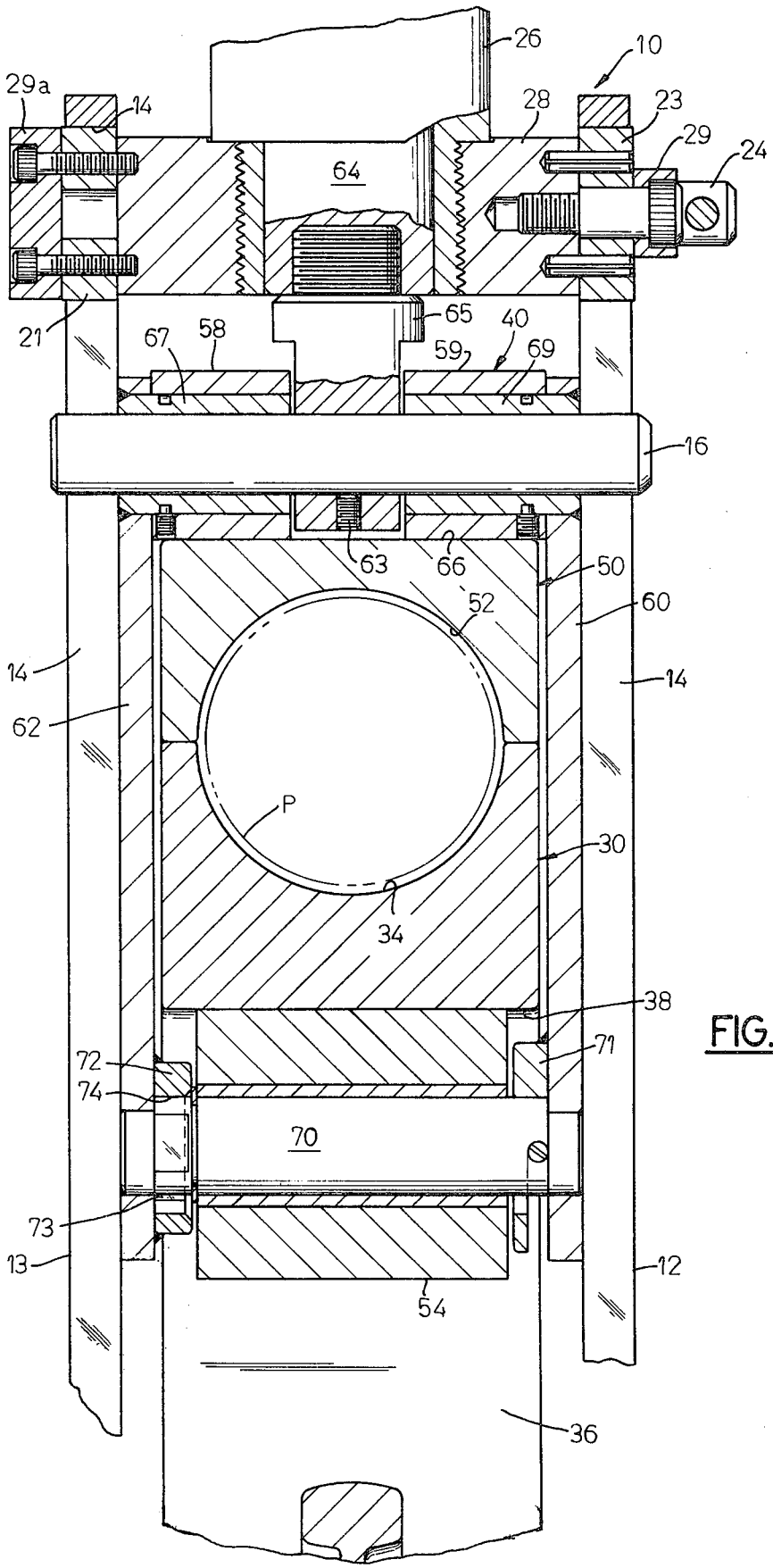
FIG. 4 is a cross-sectional view taken generally along the line 4—4 in FIG. 1.

Such compressive force is generated by a clamping means 40 which comprises a plurality of rollers 54, 56, 58 and 59 rotatably supported and spaced with respect to each other by a pair of linking plates 60 and 62. As shown in FIGS. 1 and 4–6, the plates 60 and 62 are received between and adjacent to the frame arms 12 and 13 and are slideable with respect to the frame arms 12 and 13 during bending of the pipe P. The rollers 58 and 59 are mounted vertically with respect to each other and are rotatably mounted on the pin 16 which extends through a vertically extending bore in the end 65 of the piston rod 64. More specifically, as shown in FIG. 4, the pin 16 is secured within the piston end 65 by a set screw 63. The linking plates 60 and 62 each include opposed inwardly extending bushings 67 and 69 which receive opposite ends of the pin 16. The rollers 58 and 59 and the roller 56 which is rotatably supported by a pin 68, are engageable with the surface 66 of the follower shoe 50 and function to force the follower shoe 50 into engagement with the pipe P and toward the bending shoe 30. The plates 60 and 62 also function to support the bending shoe 30, and the follower shoe in horizontal alignment with each other. The plates include projecting portions 63 which provide additional support for the shoes to ensure their alignment and to prevent binding during the bending operation.

The other roller 54 of the clamping means 40 is received against the arcuate surface 38 of the bending shoe such that the pipe P, the follower shoe 50 and the bending shoe 30 are, in effect, held in clamping engagement between the rollers of the clamping assembly 40. The roller 54 is rigidly but rotatably supported by an eccentric shaft 70 which is secured at its ends in the plates 60 and 62. The shaft is also supported by a bushing 71 welded to the inner surface of the plate 60 and by a bushing 72 welded to the inner surface of the plate 62. The bushing 72 includes a pair of flats 73 on its inner bore 74 for receiving complementary flats on the sides of the eccentric shaft 70. When the eccentric shaft 70 is positioned with the complementary flats of the shaft and the bushing 72 disposed as shown in FIG. 4, the roller 54 will be positioned in relatively closely spaced relationship with respect to the roller 56 such that the rollers support the bending shoe 30 in clamping engagement with the pipe P and the follower shoe 50. Due to the eccentricity of the shaft 70, however, it is also possible, by rotating the shaft 180°, to increase the gap between the roller 54 and the rollers 56, 58 and 59 thereby decreasing the pressure applied by the bending shoe 30. The ecentric shaft mechanism illustrated as the means to support the roller 54 and to adjust the spacing between the rollers of the clamping means 40 is only one of several possible alternatives, and it should be clear that any of a plurality of similar adjustment means are within the scope of the invention.

Operation

Figure 5:
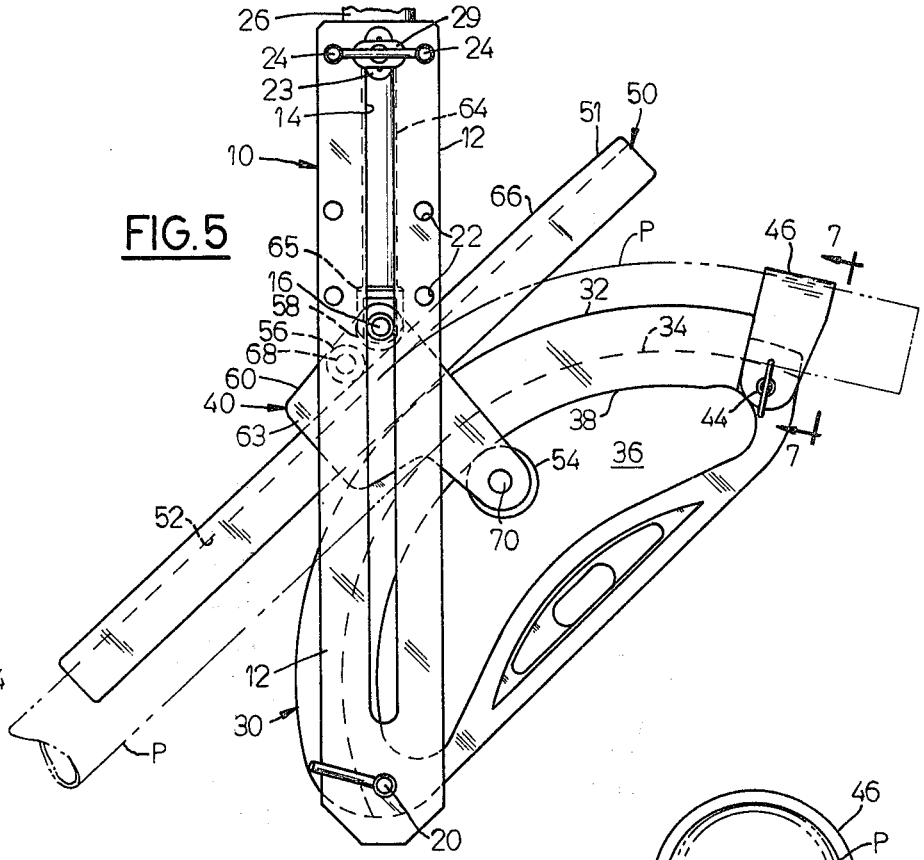
FIG. 5 is a view similar to that shown in FIG. 1 but showing the pipe bending assembly in an intermediate stage of its operation.
Figure 7:
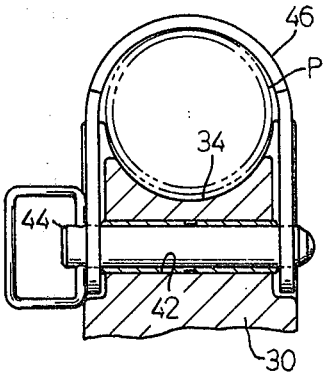
FIG. 7 is a view taken generally along the line 7—7 in FIG. 5.
Figure 6:
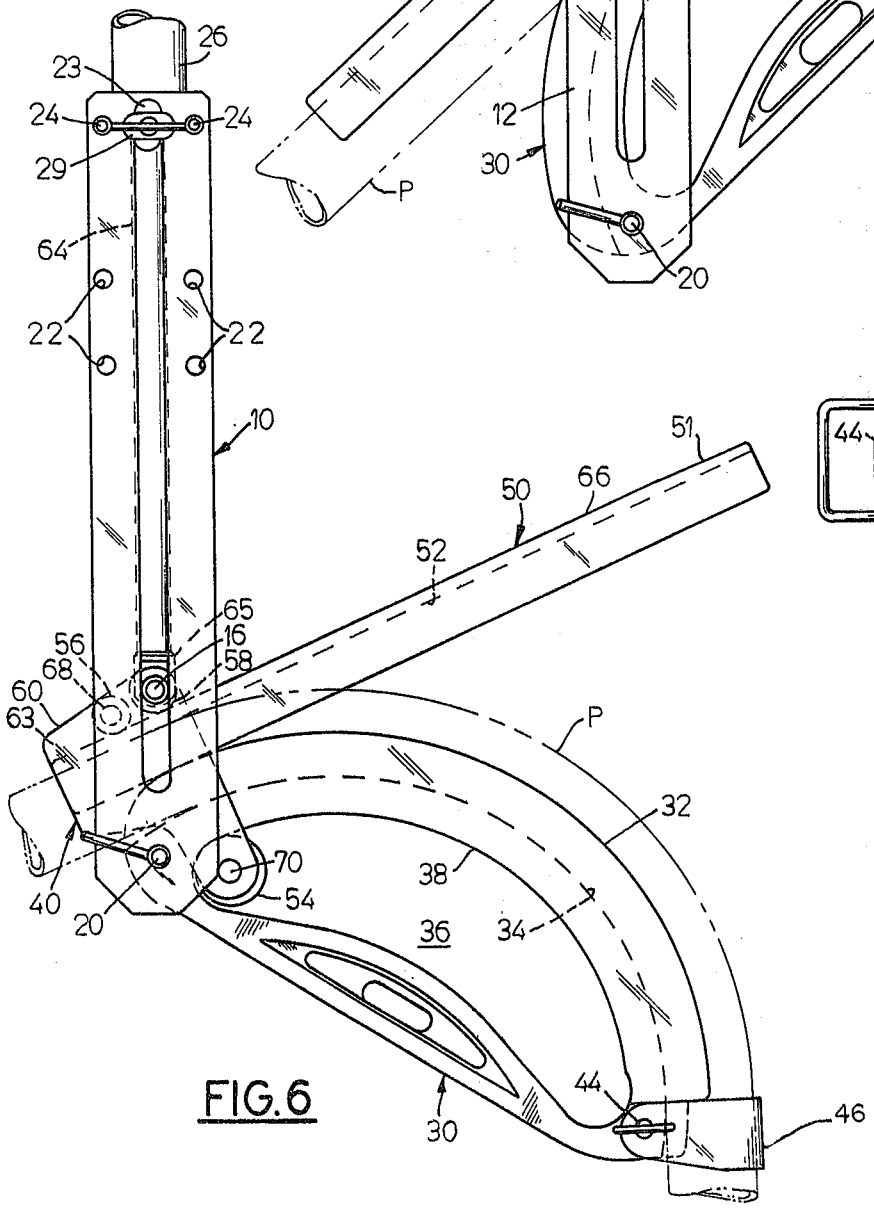
FIG. 6 is a view similar to FIGS. 1 and 5 but showing the pipe bending assembly at the completion of a pipe bending operation.

The successive steps of a pipe bending operation using the apparatus of the present invention are best shown in FIGS. 1, 5 and 6. With the bending shoe 30 positioned as shown in FIG. 1, a pipe P may be positioned between the frame arms 12 and 13 within the groove 34 in the bending shoe 30. The saddle 46 is then placed over the end of the pipe P and secured in place with the saddle pin 44 as shown in FIG. 7. The follower shoe 50, which is freely removable from the apparatus, is then inserted between the pipe P and the rollers 56, 58 and 59. It should be noted that the follower shoe 50 includes an inclined surface 51 on its forward end so that it is easily insertable between the pipe P and the rollers.

With the elements of the bending apparatus in the position as shown in FIG. 1, the fluid motor 26 is actuated to cause the piston 64 to extend and to cause the clamping assembly 40, connected to the end of the piston, to create torque on the bending shoe 30 thereby causing initial horizontal pivotal movement of the bending shoe 30 around the pivot pin 20. When the fluid motor 26 is actuated, the rollers 56, 58 and 59 are forced against the follower shoe 50, and the follower shoe 50 in turn places a compressive force on the pipe P. The pipe P exerts a force on the surface of the bending shoe 30 generally acting in a direction normal to the surface where it contacts the arcuate surface 32 thus creating a torque on the bending shoe 30 about the pivot pin 20. This torque results in rotation of the bending shoe 30 around the pivot pin 20. It should be readily apparent, however, that the fluid motor 26 does not function directly to apply a compressive force on the pipe P but merely functions to cause pivotal movement of the bending shoe 30. The compressive force is generated by the compression of the rollers 54, 56, 58 and 59 on the respective shoes 30 and 50 in the manner previously described. As the bending shoe continues to rotate in the manner shown in FIGS. 5 and 6, the rollers will maintain clamping engagement between the follower shoe 50 and the bending shoe 30 and will cause the pipe P to conform to the surface configuration of the arcuate surface 32 thus creating a bend in the pipe. During this operation, the roller 54 will traverse the arc defined by the arcuate surface 38 and the rollers 56, 58 and 59 will traverse the length of the follower shoe surface 66.

In the event that the hydraulic motor 26 does not have a piston 64 of sufficient length to form a complete bend in the pipe, after a first stroke is completed and a partial bend formed, the pins 24 may be removed and the hydraulic motor may be slideably moved toward the pipe until bores 27 are aligned with a closer set of bores 22 in the arm 12 and 13. The pins may then be reinserted and the motor 26 actuated again to complete the bend.

The apparatus of the present invention is also equally adaptable to be used to bend pipe which is of sufficient wall thickness that it is not subjected to undesirable deformations of thin walled pipe. In such cases, it is generally unnecessary to use the follower shoe 50. Instead, the rollers 56 and 58 can be provided with external surfaces which conform to the shape of the pipe being bent or as an alternative, they can be fitted with elastomeric sleeves wherein they can be used to exert pressure directly onto the pipe during the bending operation.

The apparatus of the present invention is also readily adapted for use in bending pipes which have varying diameters including pipes having diameters of up to 6 inches. In order to bend pipes having different diameters, it is necessary to use bending shoes 30 and follower shoes 50 which have grooves equal to the diameters of the pipe to be bent. When it is desired to substitute a different bending shoe for that being used, the frame of the apparatus can be readily disassembled by removal of the pivot pin 20 and the two pivot pins 24 which thus permit removal of the upper frame arm 12.

A bending shoe having a groove of the desired cross-sectional diameter can then be substituted and the arm 12 replaced. In the event that the replacement bending shoe is, for example, substantially shorter than the previously used bending shoe, the hydraulic motor 26 can be slideably moved in the slots 14 until the bores 27 in cylinder head 28 are aligned with a closer pair of the spaced bores 22 and pins 24 can be reinserted to secure the motor 26 in place with respect to the arms 12 and 13.

Resume

The pipe bending apparatus of the present invention thus provides a means for bending thin or thick walled pipe, and is readily adaptable for use in bending pipes having various diameters. The apparatus has the advantage that pressure can be maintained on and around the entire periphery of the pipe where it is being bent during the bending process to preclude kinks or any other type of undesirable distortion of the pipe even though the pipe is constructed from relatively soft material or has thin walls. The invention also has the advantage that it can be readily converted for use with pipes having different diameters or for use with pipes which have sufficient wall thickness that they are self-supporting. The invention also includes a means for applying compressive forces against the pipe bending shoes which ensures consistent pressure throughout the length of the bend and which requires a relatively small hydraulic motor when compared to those used in the prior art. The apparatus is also capable of forming a continuous 90° bend even in large diameter thin walled pipes.

I claim:

1. A pipe bending apparatus comprising:

a frame having opposite ends;

a bending shoe having a first arcuate surface for receiving a pipe thereagainst and a second arcuate surface concentric with said first arcuate surface;

means for pivotably connecting said bending shoe to one end of said frame and adjacent an end of said first arcuate surface;

clamping means for clamping said pipe against said first arcuate surface, said clamping means being moveable relative to said frame, said clamping means comprising a pair of spaced apart members for receiving said pipe and said second arcuate surface therebetween, one of said members exerting force against said pipe and the other of said members exerting force against said second arcuate surface; and motor means comprising a fixed member and a relatively extendable member, said fixed member being connected to said other end of said frame and said relatively extendable member being connected to said clamping means for moving said clamping means relative to said frame.

2. The pipe bending apparatus set forth in claim 1 wherein the frame includes an elongated member for guiding said clamping means for translational movement with respect to said frame wherein the clamping means causes pivotal movement of the bending shoe about said pivot point.

3. The pipe bending apparatus set forth in claim 1 wherein said clamping means includes a pair of plates supporting said spaced apart members therebetween.

4. The pipe bending apparatus set forth in claim 1 wherein said spaced apart members each comprise a roller.

5. The pipe bending apparatus set forth in claim 4 wherein one of said rollers is mounted on a rotatable eccentric shaft.

6. The pipe bending apparatus set forth in claim 1 wherein said frame comprises a pair of spaced apart parallel elongated arms and wherein said clamping means includes a pair of spaced apart plates supporting said members therebetween, said plates being received between said elongated arms and moveable translationally therebetween.

7. The pipe bending apparatus set forth in claim 1 further including a straight follower shoe for cooperative engagement with said first arcuate surface, said spaced apart members clampingly engaging said follower shoe and said bending shoe together.

8. A pipe bending apparatus for bending large diameter pipe and comprising:

a frame having opposite ends;

a bending shoe including a first arcuate surface for receiving a pipe thereagainst and a second arcuate surface concentric with said first arcuate surface;

means for pivotably securing said bending shoe to one of said opposite ends of said frame so that said bending shoe is pivotable about a pivot point adjacent an end of said first arcuate surface;

a straight follower shoe receivable against said first arcuate surface for cooperative engagement with said bending shoe to define a pipe receiving space with said first arcuate surface;

clamping means for clamping said pipe in tightly engaged relationship between said bending shoe and the follower shoe and for applying compressive force to said pipe during the bending operation, said clamping means including a pair of spaced rollers for receiving said shoes therebetween in compressive engagement, one of said rollers engageable against said follower shoe and the other of said rollers engageable against said second arcuate surface; and motor means comprising a fixed member and a relatively extendable member, said fixed member being supported by the other of said opposite ends of the frame and said relatively extendable member being operably connected to said clamping means for moving the clamping means translationally relative to said frame whereby said bending shoe is caused to pivot about said pivot point.

9. The pipe bending apparatus set forth in claim 8 wherein said frame comprises a pair of spaced apart parallel elongated arms and wherein said clamping means includes a pair of spaced apart plates supporting said members therebetween, said plates being received between said elongated arms and moveable translationally from one end of said arms to the other end.

* * * * *